United States Patent [19]

Cantarano

[11] 3,956,523

[45] *May 11, 1976

[54] NON-ELECTROSTATIC PRINTING METHOD EMPLOYING AN INSULATING IMAGE CARRIER

[76] Inventor: Marcus Cantarano, No. 47 Ave. F. Roosevelt, 94320 Thiais, France

[ * ] Notice: The portion of the term of this patent subsequent to July 30, 1991, has been disclaimed.

[22] Filed: Jan. 9, 1974

[21] Appl. No.: 431,959

Related U.S. Application Data

[63] Continuation of Ser. No. 151,488, June 9, 1971, Pat. No. 3,826,672, which is a continuation-in-part of Ser. No. 631,972, April 18, 1967, abandoned.

[52] U.S. Cl. ..... 427/24; 96/1.4; 427/12; 427/14

[51] Int. Cl.[2] ..... G03G 17/00

[58] Field of Search ..... 117/17.5; 96/15 D, 1.4; 427/12, 14, 24

[56] References Cited

UNITED STATES PATENTS

| | | | |
|---|---|---|---|
| 3,721,551 | 3/1973 | Cantarano | 117/17.5 |
| 3,741,761 | 6/1973 | Cantarano | 117/17.5 |
| 3,776,722 | 12/1973 | Cantarano | 117/17.5 |
| 3,826,672 | 7/1974 | Cantarano | 117/17.5 |

*Primary Examiner*—Ralph Husack
*Assistant Examiner*—Stuart D. Frenkel

[57] ABSTRACT

Method for producing electrographic images from an original provided with a conductivity pattern ranging from a portion having a greater conductivity to a portion having a lesser conductivity, said conductivity pattern being affixed to an insulating backing material, comprising the steps of coating said conductivity pattern with a thin layer of electrically chargeable particles, disposing an insulating layer against said conductivity pattern, so that said layer of electrically chargeable particles is located between said conductivity pattern and said insulating layer, generating an electric field of sufficient strength across said insulating layer, said layer of electrically chargeable particles, said conductivity pattern and said insulating backing so as to transfer electric charges from said conductivity pattern to said electrically chargeable particles whereby a portion of said particles are sufficiently charged and removed from said conductivity pattern and the remainder of said particles are insufficiently charged to be removed thereby producing a stable electrographic image. An insulating image carrier may be used onto which said removed portion of the particles may form a second stable electrographic image.

4 Claims, 3 Drawing Figures

NON-ELECTROSTATIC PRINTING METHOD EMPLOYING AN INSULATING IMAGE CARRIER

Figure 1:
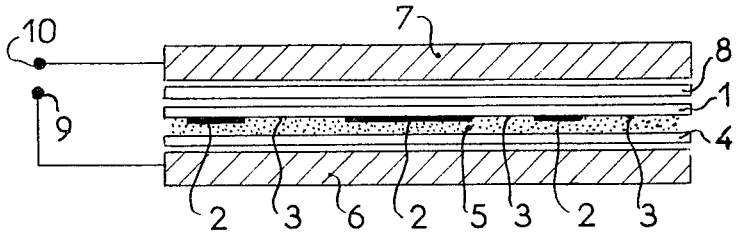

This application is a continuing application of Ser. No. 151,488, filed on June 9, 1971 and now U.S. Pat. No. 3,826,672, issued on July 30, 1974; which application in turn is a continuation-in-part of application Ser. No. 631,972 filed Apr. 18, 1967 and now abandoned.

This invention relates to the production of electrographic images from an original provided with a conductivity pattern.

As used herein, the term "conductivity pattern" is to be understood as including any virtually plane surface formed by parts having different electric conductivities.

The term "insulating" is to be understood as defining the quality of having an electric conductivity lower than $10^{-11}$mho/cm and the term "non-insulating" as defining the quality of having an electric conductivity superior to $10^{-11}$mho/cm.

In the actual art, a feature of electrographic methods resides in the use of an original provided with a conductivity pattern including high insulating parts which will selectively hold electric charges to form a latent electrostatic image; thus an electrographic image may be developed by an electrically responsive powder which adheres to the charged parts of the latent image. This electrographic image will not be obtained in a stable way because of the passage of electric charges even through the high insulating parts of the original causing the effacement of at least a part of the latent image during the step of the development. A typical original of actual electrography consists in a photoconductive layer provided with a conductivity pattern resulting from an exposure to the optic image of a document to reproduce. Such a photoconductive layer will be a high insulator in the dark in order to obtain a conductivity pattern including the non-illuminated high insulating parts serving to develop an electrographic image according to existing methods. These photoconductive insulating layers are slow in their response to successive different exposures to the light and, consequently, they may not be used to afford high speed processes to produce successive different electrographic images. Now in accordance with the present invention, it has been found that a stable electrographic image may be formed and simultaneously developed from any original provided with a pattern of conductive and low conductive parts in the absence of a latent electrostatic image.

According to the present invention, an original is used which is provided with a pattern of conductive and low conductive parts affixed onto an insulating backing material. The conductivity pattern of the original is coated with a thin layer of electrically chargeable developer particles, an insulating layer is placed against the layer of particles, and an electric field is generated to charge the particles from said conductivity pattern and thus to apply to the particle layer electric charges having values in proportion to the conductivities of said pattern. Under the action of the electric field, the charged particles are electrically attracted away from the most conductive parts of said pattern while, because of the insulation of the coated conductivity pattern between the insulating backing and the insulating layer, the remaining part of the particle layer is never sufficiently charged to be removed and thus it develops a stable electrographic image on the least conductive parts of said pattern.

An object of this invention is to provide methods and means for use in electrography.

Other objects of this invention will be apparent from the following description and accompanying drawing taken in connection with the appended claims.

Figure 2:
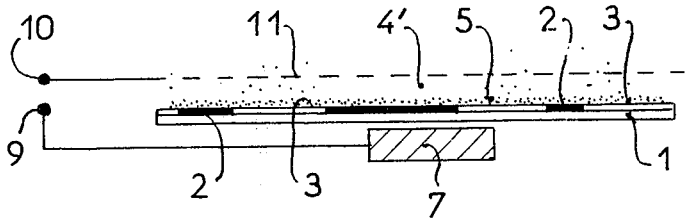
Figure 3:
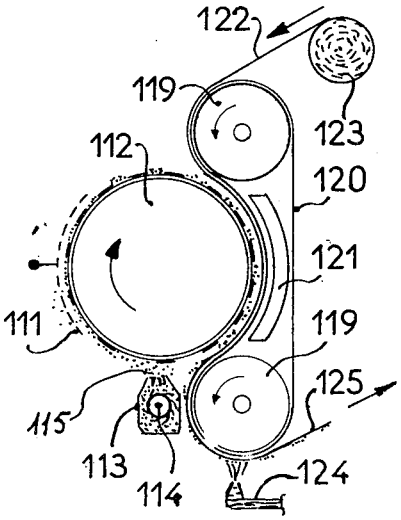

Several embodiments of the invention will now be described by way of example and with reference to the accompanying drawing, in which:

FIG. 1 is a sectional view showing an original and a sheet serving as an image carrier, arranged between two electrodes, FIG. 2 is a schematic representation of the arrangement of an original between a grid-shaped first electrode and a second electrode, FIG. 3 is a schematic representation of an embodiment of the device according to the invention.

In the arrangement shown in FIG. 1 for producing an electrographic image, an original provided with indicia 2 having an electric conductivity other than the surface 3 of the backing material 1 is disposed between two electrodes 6 and 7. Owing to the differences of electric conductivity between the materials of the parts 1 and 2 of the original, the latter is provided with a conductivity pattern formed by areas 2 of the indicia and the blank surface 3 of the backing 1. The conductivity pattern 2, 3 is coated with a thin layer of electrically chargeable particles 5. Such coating of the particles 5 onto the original can be accomplished in the well known manner by the use of rotating brushes, or by spraying or by cascading the particles. Also arranged between the electrodes 6 and 7 is an image carrier 4 placed against the layer of coating particles 5. A dielectric 8, which is disposed between the original and the electrode 7, may consist of a sheet of MYLAR of a thickness of about 150 microns, for example. Furthermore, a second similar dielectric sheet may be arranged between the image carrier 4 and the electrode 6. Indicia 2 may be of different types such as typewriting or pencil traces. On the other hand, if continuous tone electrographic images are to be produced, any original may be used which is provided with a conductivity pattern comprising differently conductive indicia 2 forming dense areas and half-shadow areas, as like a photographic print.

Since it is not important as far as this invention is concerned just how the conductivity pattern of the original is formed, but instead it is important as regards this invention that the particle layer 5 is placed in electric contact with a conductivity pattern to reproduce.

An electric high voltage is applied to the terminals 9 and 10 to generate an electric field between the electrodes 6 and 7. For example, a direct voltage of 25 KV may be applied to the terminals for a period of a few milliseconds. However, it is advantageous to generate an alternating voltage, for example, of 50 cycles/sec and 5 KV. Instead of this, an attenuated or an alternatively modulated voltage may be applied to terminals 9 and 10. Under the action of the electric field, the particles 5 receive electric charges having different maximum values according to the different conductivities of the pattern 2, 3 and thus the grains of the particle layer 5, according to the different maximum values of their charges, are differently attracted toward the original and toward the image carrier 4. When, subsequently, the electrodes 6 and 7 are separated and the image carrier 4 is detached from the original, a part of the layer of particles 5 will be found forming an electrographic image on the image carrier 4, and the remaining part of the particle layer forms another electrographic image on the original. According to the experience, the two electrographic images are obtained in substantial configuration with the indicia 2 and the blank surface 3 of the original.

In the arrangement shown in FIG. 2, a particle-coated original provided with a pattern of conductive indicia 2 and low conductive parts 3 is disposed under an electrode in the form of a grid 11. The thin layer of developer particles 5 is insulated from the grid 11 by a fluid dielectric 4'. The grid 11 may be made of brass and have a mesh width of 0.5 mm, for example. The particles 5 are applied loosely-adhering to the conductivity pattern 2, 3. In accordance with the experience, the particles will better adhere to the original by providing an electrode 7 in the form of wires onto which strongly converge the lines of force of the electric field generated between the electrodes 7 and 11. Under the influence of this field the particles are electrically charged and removed from the conductive indicia 2, while the particles coating the low conductive parts 3 are never sufficiently charged to electrically overcome their adherence to the parts 3 and thus develop a stable electrographic image thereon. The space between the electrode 11 and the particles 5 must be sufficiently thick so that the intensity of the electric field does not exceed 3 V/micron in the layer of air 4' to avoid an electric discharge between the electrode 11 and the particles 5. Instead of the air 4', any other insulating gas as well as an insulating liquid may be used as fluid dielectric 4'. What matters is that the particle layer 5 is insulated from the electrode 11 and that the layer 4' permits the passage of the particles 5 attracted away from the original during the development; these particles thus migrate through the openings of the grid 11 and they are definitively removed from the electric field. Furthermore, in accordance with the present invention, when a direct field is generated between the electrodes 7 and 11, the conductivity pattern 2, 3 will be electrically insulated from the electrode 7 to prevent any direct electric current filterring through the low conductive parts 3 from electrically charging and removing even the part of the particle layer which costs the parts 3 and which serves to develop the stable image. Such insulation of the pattern 2, 3 is generally constituted by the insulating backing 1 of the original. If, on the contrary, the backing 1 is made of a low insulating material, a dielectric has to be arranged between the latter and the electrode 7.

In the device of FIG. 2, an alternating voltage may be applied to the terminals 9 and 10. The particles 5 thus receive from the pattern 2, 3 alternating electric charges having different maximum values in proportion to the conductivities and said pattern and the most charged particles are electrically attracted through the grid electrode 11. Under the influence of the alternating voltage the particles are electrically removed from the conductive indicia 2 while the particles coating the low conductive parts 3 are never sufficiently charged to overcome their adherence to the parts 3 and thus they form a stable electrographic image thereon.

In addition, in the device of FIG. 2, an original may be used which is provided with a pattern 2, 3 affixed to an insulating backing 1. By applying an alternating or an alternatively modulated electric field, the coating particles 5 receive from the pattern 2, 3 alternating electric charges having maximum values in proportion to the conductivities of said pattern 2, 3; under the influence of the alternatively modulated voltage the particles are electrically attracted from the conductive indicia 2 and through the grid 11 while the remaining part of the particles develop a stable electrographic image on the low conductive parts 3.

On the other hand the original, the electrode 7 and electrode 11 may be disposed parallel to a vertical plane, such a vertical arrangement of parts is shown in the left-hand part of FIG. 3, in which figure the grid 111 corresponds to the grid electrode 11 of FIG. 2.

The device of FIG. 2 can also be used to produce two stable electrographic images simultaneously from the same original by placing against the layer of particles 5 an insulating paper of copy intercepting the particles electrically removed from the indicia 2 during the application of the electric field. Such a disposition of parts is shown in FIG. 1, the insulating paper of copy constituting the image carrier 4 placed against the layer of particles 5.

In carrying out this invention a developer powder of charcoal has been found useful to form the particle layer 5. Alternatively, other developer powders, such as metallic or thermoplastic powders may be used as well as liquid or plastic developers. When a developer powder is used, its grains can be advantageously coated with stearic acid or zinc or aluminium stearate; such a treatment will render the powder somewhat adhesive and give to its grains a very thin insulating coat which prevents electric discharges between contiguous particles of the layer 5 during the application of the electric field. Furthermore, after the charging of conductive particles in the device of FIG. 1, these particles 5 will conserve intense residual charges because of their insulating coats and thus they may be attracted by said attenuated electric field to form electrographic images. These residual charges of the particles also serve to maintain the obtained particles images on the original and on the image carrier 4, after the application of the electric field.

Other high insulating plastic or thermoplastic developers may be used. If required, these insulating materials may be rendered conductive by mixing them with pure carbon, as well known in the art.

For carrying out the invention as described with reference to FIG. 2, an apparatus of the type illustrated in FIG. 3 may be used. In this case, for simplifying the operation an inverted original may be used so that the electrographic image is developed by the particles on the low conductive indicia of the original. The original is secured to the periphery of a rotatable drum 112. A spraying device 113 including a rotatable brush 114 is arranged for spraying the developer powder through a grid 115 to uniformly coat the surface of the original on the rotating drum 112. An electric voltage may be applied between the drum 112 and the grid 115 to aid the spraying of the powder on the original. When the drum 112 is rotating the powder-coated original passes below a grid 111 which is equivalent to the grid 11 of FIG. 2. When a voltage is applied between the grid 111 and the rotatable drum 112, the conditions described with reference to FIG. 2 are obtained.

As shown in the right-hand of FIG. 3, the apparatus comprises a pair of rollers 119 guiding an endless belt 120 of dielectric material. The belt 120 is adapted to be placed towards the drum 112 by an arcuate electrode 121. The two rollers 119, moreover, serve to guide a sheet of paper 122 which is unwound from a supply roller 123. The transfer of the grains of particles 5 that have remained on the original affixed to the rotating drum 112 to the sheet of paper 122 is effected while the latter is continuously placed against the rotating drum 112 so that an upright image is produced on the sheet of paper 122. At the outlet of the apparatus this upright image will be fixed by an atomizer 124 adapted to spray an appropriate solvent on the sheet of paper 122. A replica of the original will then be obtained at 125 after the drying of the sheet of paper 122. This apparatus can be successfully used for the high speed production of a large number of printed matters by using an original provided with a pattern having high differences in conductivity.

The apparatus may be constructed also in such a manner that when an original is continuously advanced and simultaneously coated with a powder or a liquid, the original coated with the powder or the liquid, respectively, travels on a plane surface instead of on the cylindrical surface of the drum 112. In this manner it is avoided that parts of the powder or of the liquid, respectively, are centrifugated off.

While the method herein described constitutes a preferred embodiment of this invention, it is understood that the invention is not limited to this precise method and that changes may be made without departing from the scope of the invention which is defined in the appended claims.

What I claim is:

1. A method for producing electrographic images from an original provided with a conductivity pattern ranging from a portion having a greater conductivity to a portion having a lesser conductivity, said conductivity pattern being affixed to an insulating backing material, comprising the steps of coating said conductivity pattern with a thin uniform layer of electrically chargeable particles, placing an insulating image carrier against said layer of electrically chargeable particles so that said layer of electrically chargeable particles is sandwiched between said conductivity pattern and said insulating image carrier, and generating an electric field of sufficient strength across said image carrier, said layer of electrically chargeable particles and said conductivity pattern so as to transfer electric charges from said conductivity pattern to said electrically chargeable particles whereby said particles receive electric charges having different maximum values according to the different conductivities of said portions of said conductivity pattern whereby a portion of said particles are sufficiently charged and removed from said conductivity pattern and the remainder of said particles are insufficiently charged so that they continue to remain on said conductivity pattern thereby producing thereon a first stable electrographic image and a second stable electrographic image is formed on said insulating image carrier from said particles removed from said conductivity pattern.

2. A method as defined in claim 1 wherein said generating step includes changing the direction of said electric field.

3. A method for producing electrographic images from an original provided with a conductivity pattern ranging from a portion having a greater conductivity to a portion having a lesser conductivity, said conductivity pattern being affixed to an insulating backing material, comprising the steps of coating said conductivity pattern with a thin layer of electrically chargeable particles, disposing an insulating layer against said conductivity pattern so that said layer of electrically chargeable particles is located between said conductivity pattern and said insulating layer, generating an electric field of sufficient strength across said insulating layer, said layer of electrically chargeable particles and said conductivity pattern so as to transfer electric charges from said conductivity pattern to said electrically chargeable particles whereby said particles receive electric charges having different maximum values according to the different conductivities of said portions of said conductivity pattern whereby a portion of said particles are sufficiently charged and removed from said conductivity pattern and the remainder of said particles are insufficiently charged so that they continue to remain on said conductivity pattern thereby producing thereon a stable electrographic image.

4. A method as defined in claim 3 wherein said generating step includes changing the direction of said electric field.

* * * * *